US009924582B2

(12) United States Patent
Vendetti et al.

(10) Patent No.: US 9,924,582 B2
(45) Date of Patent: Mar. 20, 2018

(54) LUMINAIRE DIMMING MODULE USES 3 CONTACT NEMA PHOTOCONTROL SOCKET

(71) Applicant: Express Imaging Systems, LLC, Renton, WA (US)

(72) Inventors: Don Arthur Vendetti, Seattle, WA (US); William G. Reed, Seattle, WA (US)

(73) Assignee: Express Imaging Systems, LLC, Renton, WA (US)

( * ) Notice: Subject to any disclaimer, the term of this patent is extended or adjusted under 35 U.S.C. 154(b) by 0 days.

(21) Appl. No.: 15/496,985

(22) Filed: Apr. 25, 2017

(65) Prior Publication Data

US 2017/0311424 A1 Oct. 26, 2017

Related U.S. Application Data

(60) Provisional application No. 62/327,939, filed on Apr. 26, 2016.

(51) Int. Cl.
*H05B 37/02* (2006.01)
*H05B 39/04* (2006.01)
(Continued)

(52) U.S. Cl.
CPC ..... *H05B 37/0272* (2013.01); *H05B 33/0803* (2013.01); *H05B 33/0845* (2013.01); *H05B 39/041* (2013.01); *H05B 39/09* (2013.01)

(58) Field of Classification Search
CPC ..... H05B 37/0272; H05B 33/0803; H05B 33/0845; H05B 39/041; H05B 39/09
(Continued)

(56) References Cited

U.S. PATENT DOCUMENTS 2,240,050 A 4/1941 Nuebling
2,745,055 A 5/1956 Woerdemann
(Continued)

FOREIGN PATENT DOCUMENTS

CN 103162187 A 6/2013
DE 40 01 980 A1 8/1990
(Continued)

OTHER PUBLICATIONS

Notice of Allowance dated Mar. 24, 2017, for Reed, "Apparatus and Method of Energy Efficient Illumination Using Received Signals," U.S. Appl. No. 14/557,275, 23 pages.
(Continued)

*Primary Examiner* — Don Le
(74) *Attorney, Agent, or Firm* — Seed IP Law Group LLP

(57) ABSTRACT

An article and circuit that controllably dims a luminaire, for example without controlling a line power of the luminaire. The luminaire includes a traditional three-contact socket to receive a photocontroller, such as that used for street lights. The article uses a desired dimming control signal to provide an output control signal that controls whether the light source in the luminaire is turned ON or turned OFF to thereby effect the desired amount of dimming. The output control signal may be a pulse width modulated (PWM) signal with a duty cycle that is related to the desired level of illumination or dimming. The system may use a dimming signal from a five or seven contact dimming photocontroller to provide such an output control signal to control the light-level for the luminaire.

21 Claims, 3 Drawing Sheets

(51) Int. Cl.
*H05B 33/08* (2006.01)
*H05B 39/09* (2006.01)

(58) Field of Classification Search
USPC ..... 315/291
See application file for complete search history.

(56) References Cited

U.S. PATENT DOCUMENTS 3,374,396 A 3/1968 Bell et al.
4,153,927 A 5/1979 Owens
4,237,377 A 12/1980 Sansum
4,663,521 A 5/1987 Maile
5,086,379 A 2/1992 Denison et al.
5,160,202 A 11/1992 Légaré
5,161,107 A 11/1992 Mayeaux et al.
5,230,556 A 7/1993 Canty et al.
5,276,385 A 1/1994 Itoh et al.
5,343,121 A 8/1994 Terman et al.
5,349,505 A 9/1994 Poppenheimer
5,450,302 A 9/1995 Maase et al.
5,561,351 A 10/1996 Vrionis et al.
5,589,741 A 12/1996 Terman et al.
5,808,294 A 9/1998 Neumann
5,869,960 A 2/1999 Brand
5,892,331 A 4/1999 Hollaway
5,892,335 A 4/1999 Archer
5,936,362 A 8/1999 Alt et al.
5,995,350 A * 11/1999 Kopelman ..... H02H 5/047 361/103
6,111,739 A 8/2000 Wu et al.
6,149,283 A 11/2000 Conway et al.
6,154,015 A 11/2000 Ichiba
6,160,353 A 12/2000 Mancuso
6,198,233 B1 * 3/2001 McConaughy ..... F21V 23/02 315/209 R
6,211,627 B1 * 4/2001 Callahan ..... H05B 37/02 315/199
6,377,191 B1 4/2002 Takubo
6,612,720 B1 9/2003 Beadle
6,674,060 B2 1/2004 Antila
6,681,195 B1 1/2004 Poland et al.
6,746,274 B1 6/2004 Verfuerth
6,753,842 B1 6/2004 Williams et al.
6,828,911 B2 12/2004 Jones et al.
6,841,947 B2 1/2005 Berg-johansen
6,880,956 B2 4/2005 Zhang
6,902,292 B2 6/2005 Lai
6,985,827 B2 1/2006 Williams et al.
7,019,276 B2 3/2006 Cloutier et al.
7,066,622 B2 6/2006 Alessio
7,081,722 B1 7/2006 Huynh et al.
7,122,976 B1 10/2006 Null et al.
7,188,967 B2 3/2007 Dalton et al.
7,190,121 B2 3/2007 Rose et al.
7,196,477 B2 3/2007 Richmond
7,252,385 B2 8/2007 Engle et al.
7,258,464 B2 8/2007 Morris et al.
7,270,441 B2 9/2007 Fiene
7,281,820 B2 10/2007 Bayat et al.
7,294,973 B2 11/2007 Takahama et al.
7,314,291 B2 1/2008 Tain et al.
7,317,403 B2 1/2008 Grootes et al.
7,322,714 B2 1/2008 Barnett et al.
7,330,568 B2 2/2008 Nagaoka et al.
7,339,323 B2 3/2008 Bucur
7,339,471 B1 3/2008 Chan et al.
7,405,524 B2 7/2008 Null et al.
7,438,440 B2 10/2008 Dorogi
7,440,280 B2 10/2008 Shuy
7,468,723 B1 12/2008 Collins
7,524,089 B2 4/2009 Park
7,538,499 B2 5/2009 Ashdown
7,547,113 B2 6/2009 Lee
7,559,674 B2 7/2009 He et al.
7,564,198 B2 7/2009 Yamamoto et al.
7,569,802 B1 8/2009 Mullins
7,578,596 B2 8/2009 Martin
7,578,597 B2 8/2009 Hoover et al.
7,623,042 B2 11/2009 Huizenga
7,627,372 B2 12/2009 Vaisnys et al.
7,631,324 B2 12/2009 Buonasera et al.
7,633,463 B2 12/2009 Negru
7,638,743 B2 12/2009 Bartol et al.
7,665,862 B2 2/2010 Villard
7,677,753 B1 3/2010 Wills
7,688,002 B2 3/2010 Ashdown et al.
7,688,222 B2 3/2010 Peddie et al.
7,697,925 B1 4/2010 Wilson et al.
7,702,135 B2 4/2010 Hill et al.
7,703,951 B2 4/2010 Piepgras et al.
7,746,003 B2 6/2010 Verfuerth et al.
D621,410 S 8/2010 Verfuerth et al.
D621,411 S 8/2010 Verfuerth et al.
7,798,669 B2 9/2010 Trojanowski et al.
7,804,200 B2 9/2010 Flaherty
7,828,463 B1 11/2010 Willis
7,834,922 B2 11/2010 Kurane
7,872,423 B2 1/2011 Biery et al.
7,932,535 B2 4/2011 Mahalingam et al.
7,940,191 B2 5/2011 Hierzer
7,952,609 B2 5/2011 Simerly et al.
7,960,919 B2 6/2011 Furukawa
7,983,817 B2 6/2011 Breed
7,985,005 B2 7/2011 Alexander et al.
8,100,552 B2 1/2012 Spero
8,118,456 B2 2/2012 Reed et al.
8,143,769 B2 3/2012 Li
8,174,212 B2 5/2012 Tziony et al.
8,183,797 B2 5/2012 McKinney
8,207,830 B2 6/2012 Rutjes et al.
8,260,575 B2 9/2012 Walters et al.
8,290,710 B2 10/2012 Cleland et al.
8,324,840 B2 12/2012 Shteynberg et al.
8,334,640 B2 12/2012 Reed et al.
8,344,665 B2 1/2013 Verfuerth et al.
8,376,583 B2 2/2013 Wang et al.
8,378,563 B2 2/2013 Reed et al.
8,395,329 B2 3/2013 Jutras et al.
8,445,826 B2 5/2013 Verfuerth
8,450,670 B2 5/2013 Verfuerth et al.
8,457,793 B2 6/2013 Golding et al.
8,476,565 B2 7/2013 Verfuerth
8,508,137 B2 8/2013 Reed
8,541,950 B2 9/2013 Reed
8,586,902 B2 11/2013 Verfuerth
8,604,701 B2 12/2013 Verfuerth et al.
8,610,358 B2 12/2013 Reed
8,629,621 B2 1/2014 Reed
8,749,635 B2 6/2014 Högasten et al.
8,764,237 B2 7/2014 Wang et al.
8,779,340 B2 7/2014 Verfuerth et al.
8,779,686 B2 7/2014 Jin
8,810,138 B2 8/2014 Reed
8,866,392 B2 10/2014 Chen
8,866,582 B2 10/2014 Verfuerth et al.
8,872,964 B2 10/2014 Reed et al.
8,878,440 B2 11/2014 Reed
8,884,203 B2 11/2014 Verfuerth et al.
8,896,215 B2 11/2014 Reed et al.
8,901,825 B2 12/2014 Reed
8,921,751 B2 12/2014 Verfuerth
8,922,124 B2 12/2014 Reed et al.
8,926,138 B2 1/2015 Reed et al.
8,926,139 B2 1/2015 Reed et al.
8,975,827 B2 3/2015 Chobot et al.
8,987,992 B2 3/2015 Reed
9,002,522 B2 4/2015 Mohan et al.
9,024,545 B2 5/2015 Bloch et al.
9,084,310 B2 7/2015 Bedell et al.
9,119,270 B2 8/2015 Chen et al.
9,185,777 B2 11/2015 Reed
9,204,523 B2 12/2015 Reed et al.
9,210,751 B2 12/2015 Reed
9,210,759 B2 12/2015 Reed

(56) References Cited

U.S. PATENT DOCUMENTS

| | | | | |
|---|---|---|---|---|
| 9,288,873 | B2 | 3/2016 | Reed | |
| 9,414,449 | B2 | 8/2016 | Reed | |
| 9,450,347 | B2 * | 9/2016 | Kondou | H01R 13/6683 |
| 9,462,662 | B1 | 10/2016 | Reed | |
| 9,466,443 | B2 | 10/2016 | Reed | |
| 2002/0084767 | A1 | 7/2002 | Arai | |
| 2003/0016143 | A1 | 1/2003 | Ghazarian | |
| 2003/0184672 | A1 | 10/2003 | Wu et al. | |
| 2004/0192227 | A1 | 9/2004 | Beach et al. | |
| 2005/0117344 | A1 | 6/2005 | Bucher et al. | |
| 2005/0174762 | A1 | 8/2005 | Fogerlie | |
| 2005/0179404 | A1 | 8/2005 | Veskovic et al. | |
| 2005/0231133 | A1 | 10/2005 | Lys | |
| 2006/0014118 | A1 | 1/2006 | Utama | |
| 2006/0066264 | A1 | 3/2006 | Ishigaki et al. | |
| 2006/0098440 | A1 | 5/2006 | Allen | |
| 2006/0133079 | A1 * | 6/2006 | Callahan | E04C 3/08 362/242 |
| 2006/0146652 | A1 | 7/2006 | Huizi et al. | |
| 2006/0208667 | A1 | 9/2006 | Lys et al. | |
| 2007/0032990 | A1 | 2/2007 | Williams et al. | |
| 2007/0102033 | A1 | 5/2007 | Petrocy | |
| 2007/0164689 | A1 | 7/2007 | Suzuki | |
| 2007/0224461 | A1 | 9/2007 | Oh | |
| 2007/0225933 | A1 | 9/2007 | Shimomura | |
| 2008/0018261 | A1 | 1/2008 | Kastner | |
| 2008/0025020 | A1 | 1/2008 | Kolb | |
| 2008/0043106 | A1 | 2/2008 | Hassapis et al. | |
| 2008/0062687 | A1 | 3/2008 | Behar et al. | |
| 2008/0130304 | A1 | 6/2008 | Rash et al. | |
| 2008/0215279 | A1 | 9/2008 | Salsbury et al. | |
| 2008/0224623 | A1 | 9/2008 | Yu | |
| 2008/0232116 | A1 | 9/2008 | Kim | |
| 2008/0248837 | A1 | 10/2008 | Kunkel | |
| 2008/0266839 | A1 | 10/2008 | Claypool et al. | |
| 2009/0046151 | A1 | 2/2009 | Nagaoka et al. | |
| 2009/0058320 | A1 | 3/2009 | Chou et al. | |
| 2009/0129067 | A1 | 5/2009 | Fan et al. | |
| 2009/0153062 | A1 | 6/2009 | Guo et al. | |
| 2009/0160358 | A1 | 6/2009 | Leiderman | |
| 2009/0161356 | A1 | 6/2009 | Negley et al. | |
| 2009/0167203 | A1 | 7/2009 | Dahlman et al. | |
| 2009/0195179 | A1 | 8/2009 | Joseph et al. | |
| 2009/0230883 | A1 | 9/2009 | Haug | |
| 2009/0235208 | A1 | 9/2009 | Nakayama et al. | |
| 2009/0261735 | A1 | 10/2009 | Sibalich et al. | |
| 2009/0268023 | A1 | 10/2009 | Hsieh | |
| 2009/0273290 | A1 | 11/2009 | Ziegenfuss | |
| 2009/0278479 | A1 | 11/2009 | Platner et al. | |
| 2010/0001652 | A1 | 1/2010 | Damsleth | |
| 2010/0052557 | A1 | 3/2010 | Van Der Veen et al. | |
| 2010/0096460 | A1 | 4/2010 | Carlson et al. | |
| 2010/0123403 | A1 | 5/2010 | Reed | |
| 2010/0164406 | A1 | 7/2010 | Kost et al. | |
| 2010/0171442 | A1 | 7/2010 | Draper et al. | |
| 2010/0237711 | A1 | 9/2010 | Parsons | |
| 2010/0244708 | A1 | 9/2010 | Cheung et al. | |
| 2010/0259193 | A1 | 10/2010 | Umezawa et al. | |
| 2010/0270945 | A1 | 10/2010 | Chang et al. | |
| 2010/0271802 | A1 | 10/2010 | Recker et al. | |
| 2010/0309310 | A1 | 12/2010 | Albright | |
| 2010/0328946 | A1 | 12/2010 | Borkar et al. | |
| 2011/0001626 | A1 | 1/2011 | Yip et al. | |
| 2011/0006703 | A1 | 1/2011 | Wu et al. | |
| 2011/0026264 | A1 | 2/2011 | Reed et al. | |
| 2011/0204845 | A1 | 8/2011 | Paparo et al. | |
| 2011/0215724 | A1 | 9/2011 | Chakravarty et al. | |
| 2011/0215731 | A1 | 9/2011 | Jeong et al. | |
| 2011/0221346 | A1 | 9/2011 | Lee et al. | |
| 2011/0222195 | A1 * | 9/2011 | Benoit | H01H 1/5866 361/45 |
| 2011/0248812 | A1 | 10/2011 | Hu et al. | |
| 2011/0251751 | A1 | 10/2011 | Knight | |
| 2011/0282468 | A1 | 11/2011 | Ashdown | |
| 2011/0310605 | A1 | 12/2011 | Renn et al. | |
| 2012/0001566 | A1 | 1/2012 | Josefowicz et al. | |
| 2012/0019971 | A1 | 1/2012 | Flaherty et al. | |
| 2012/0038490 | A1 | 2/2012 | Verfuerth | |
| 2012/0098439 | A1 | 4/2012 | Recker et al. | |
| 2012/0119669 | A1 | 5/2012 | Melanson et al. | |
| 2012/0119682 | A1 | 5/2012 | Warton | |
| 2012/0143383 | A1 | 6/2012 | Cooperrider et al. | |
| 2012/0153854 | A1 | 6/2012 | Setomoto et al. | |
| 2012/0169053 | A1 | 7/2012 | Tchoryk, Jr. et al. | |
| 2012/0169239 | A1 | 7/2012 | Chen et al. | |
| 2012/0181935 | A1 | 7/2012 | Velazquez | |
| 2012/0194054 | A1 | 8/2012 | Johnston et al. | |
| 2012/0209755 | A1 | 8/2012 | Verfuerth et al. | |
| 2012/0221154 | A1 | 8/2012 | Runge | |
| 2012/0224363 | A1 | 9/2012 | Van De Ven | |
| 2012/0230584 | A1 | 9/2012 | Kubo et al. | |
| 2012/0242254 | A1 | 9/2012 | Kim et al. | |
| 2012/0262069 | A1 | 10/2012 | Reed | |
| 2013/0033183 | A1 | 2/2013 | Verfuerth et al. | |
| 2013/0126715 | A1 | 5/2013 | Flaherty | |
| 2013/0131882 | A1 | 5/2013 | Verfuerth et al. | |
| 2013/0141000 | A1 | 6/2013 | Wei et al. | |
| 2013/0154488 | A1 | 6/2013 | Sadwick et al. | |
| 2013/0163243 | A1 | 6/2013 | Reed | |
| 2013/0193857 | A1 | 8/2013 | Tlachac et al. | |
| 2013/0229518 | A1 | 9/2013 | Reed et al. | |
| 2013/0235202 | A1 | 9/2013 | Nagaoka et al. | |
| 2013/0249429 | A1 | 9/2013 | Woytowitz et al. | |
| 2013/0249479 | A1 | 9/2013 | Partovi | |
| 2013/0340353 | A1 | 12/2013 | Whiting et al. | |
| 2014/0001961 | A1 | 1/2014 | Anderson et al. | |
| 2014/0028198 | A1 | 1/2014 | Reed et al. | |
| 2014/0055990 | A1 | 2/2014 | Reed | |
| 2014/0070964 | A1 | 3/2014 | Rupprath et al. | |
| 2014/0078308 | A1 | 3/2014 | Verfuerth | |
| 2014/0097759 | A1 | 4/2014 | Verfuerth et al. | |
| 2014/0159585 | A1 | 6/2014 | Reed | |
| 2014/0166447 | A1 | 6/2014 | Thea et al. | |
| 2014/0203714 | A1 | 7/2014 | Zhang et al. | |
| 2014/0225521 | A1 | 8/2014 | Reed | |
| 2014/0244044 | A1 | 8/2014 | Davis et al. | |
| 2014/0265894 | A1 | 9/2014 | Weaver | |
| 2014/0265897 | A1 | 9/2014 | Taipale et al. | |
| 2014/0313719 | A1 | 10/2014 | Wang et al. | |
| 2015/0015716 | A1 | 1/2015 | Reed et al. | |
| 2015/0077019 | A1 | 3/2015 | Reed et al. | |
| 2015/0084520 | A1 | 3/2015 | Reed | |
| 2015/0208479 | A1 | 7/2015 | Radermacher et al. | |
| 2015/0280782 | A1 | 10/2015 | Airbinger et al. | |
| 2015/0312983 | A1 | 10/2015 | Hu et al. | |
| 2016/0021713 | A1 | 1/2016 | Reed | |
| 2016/0150622 | A1 | 5/2016 | Flinsenberg et al. | |
| 2017/0055324 | A1 | 2/2017 | Reed | |

FOREIGN PATENT DOCUMENTS

| | | | |
|---|---|---|---|
| EP | 1 459 600 | B1 | 2/2004 |
| EP | 1 734 795 | A1 | 12/2006 |
| EP | 2 559 937 | A1 | 2/2013 |
| EP | 2 781 138 | A1 | 9/2014 |
| FR | 2 883 306 | A1 | 9/2006 |
| JP | 6-335241 | A | 12/1994 |
| JP | 2001-333420 | A | 11/2001 |
| JP | 2004-279668 | A | 10/2004 |
| JP | 2004-320024 | A | 11/2004 |
| JP | 2004-349065 | A | 12/2004 |
| JP | 2005-93171 | A | 4/2005 |
| JP | 2005-198238 | A | 7/2005 |
| JP | 2005-310997 | A | 11/2005 |
| JP | 2006-179672 | A | 7/2006 |
| JP | 2006-244711 | A | 9/2006 |
| JP | 2008-59811 | A | 3/2008 |
| JP | 2008-509538 | A | 3/2008 |
| JP | 2008-130523 | A | 6/2008 |
| JP | 2008-159483 | A | 7/2008 |
| JP | 2008-177144 | A | 7/2008 |
| JP | 2008-529177 | A | 7/2008 |
| JP | 2008-535279 | A | 8/2008 |
| JP | 2010-504628 | A | 2/2010 |

(56) References Cited

FOREIGN PATENT DOCUMENTS

| | | | |
|---|---|---|---|
| KR | 10-2005-0078403 | A | 8/2005 |
| KR | 10-2006-0071869 | A | 6/2006 |
| KR | 10-2006-0086254 | A | 7/2006 |
| KR | 10-2008-0100140 | A | 11/2008 |
| KR | 10-2009-0042400 | A | 4/2009 |
| KR | 10-0935736 | B1 | 1/2010 |
| KR | 20-2070-0007230 | U | 7/2010 |
| KR | 10-1001276 | B1 | 12/2010 |
| KR | 10-1044224 | B1 | 6/2011 |
| KR | 10-1150876 | B1 | 5/2012 |
| WO | 02/076068 | A1 | 9/2002 |
| WO | 03/056882 | A1 | 7/2003 |
| WO | 2005/003625 | A1 | 1/2005 |
| WO | 2007/023454 | A1 | 3/2006 |
| WO | 2006/057866 | A2 | 6/2006 |
| WO | 2007/036873 | A2 | 4/2007 |
| WO | 2008/030450 | A2 | 3/2008 |
| WO | 2008/034242 | A1 | 3/2008 |
| WO | 2009/040703 | A2 | 4/2009 |
| WO | 2010/086757 | A1 | 8/2010 |
| WO | 2010/133719 | A1 | 11/2010 |
| WO | 2011/063302 | A2 | 5/2011 |
| WO | 2011/129309 | A1 | 10/2011 |
| WO | 2012/006710 | A1 | 1/2012 |
| WO | 2012/142115 | A2 | 10/2012 |
| WO | 2013/074900 | A1 | 5/2013 |
| WO | 2014/018773 | A1 | 1/2014 |
| WO | 2014/039683 | A1 | 3/2014 |
| WO | 2014/078854 | A1 | 5/2014 |

OTHER PUBLICATIONS

Reed, "Electronic Control to Regulate Power for Solid-State Lighting and Methods Thereof," Amendment filed May 23, 2017 for U.S. Appl. No. 14/806,500, 11 pages.

Reed, "High Reliability Photocontrol Controls With 0 to 10 Volt Dimming Signal Line and Method," U.S. Appl. No. 62/507,730, filed May 17, 2017, 17 pages.

"Led Backlight I/O Ports and Power Protection Circuit Design," dated May 2, 2011, retrieved Jun. 10, 2011, from http://www.chipoy.info/gadgets/led-backlight-i-o-ports-and-power-pr . . . , 4 pages.

Corrected Notice of Allowance, dated Aug. 12, 2015, and Notice of Allowance, dated Jul. 31, 2015 for Reed et al., "Remotely Adjustable Solid-State Lamp," U.S. Appl. No. 13/875,130, 11 pages.

EE Herald, "Devices to protect High brightness LED from ESD,"dated Mar. 16, 2009, retrieved Jun. 10, 2011, from http://www.eeherald.com/section/new-products/np100779.html, 1 page.

Extended European Search Report dated Jan. 4, 2016, for corresponding EP Application No. 13823055.2-1802, 7 pages.

Extended European Search Report dated Oct. 21, 2015, for corresponding EP Application No. 13835001.2-1802, 7 pages.

Extended European Search Report dated Apr. 11, 2016, for corresponding European Application No. 16152644.7, 8 pages.

Extended European Search Report dated Aug. 13, 2014, for corresponding European Application No. 09826926.9, 8 pages.

Extended European Search Report dated May 3, 2016, for corresponding European Application No. 12771286.7, 9 pages.

Extended European Search Report dated Oct. 15, 2015, for corresponding European Application No. 12825132.9-1802, 5 pages.

Extended European Search Report dated Sep. 28, 2015, for corresponding European Application No. 12850159.0-1802, 6 pages.

Fairchild Semiconductor, "LED Application Design Guide Using Half-Bridge LLC Resonant Converter for 100W Street Lighting,"AN-9729, Fairchild Semiconductor Corporation, Rev. 1.0.0, Mar. 22, 2011, 17 pages.

Huang, "Designing an LLC Resonant Half-Bridge Power Converter,"2010 Texas Instruments Power Supply Design Seminar, SEM1900, Topic 3, TI Literature No. SLUP263, Copyright 2010, 2011, Texas Instruments Incorporated, 28 pages.

International Search Report and Written Opinion, dated May 7, 2015, for International Application No. PCT/US2015/013512, 15 pages.

International Search Report dated Nov. 11, 2014, for International Application No. PCT/US2014/047867, 3 pages.

International Search Report, dated Dec. 13, 2010 for PCT/US2010/035649, 3 pages.

International Search Report, dated Dec. 15, 2010 for PCT/US2010/035658, 3 pages.

International Search Report, dated Dec. 28, 2010 for PCT/US2010/035651, 3 pages.

International Search Report, dated Dec. 30, 2013 for PCT/US2013/058266, 3 pages.

International Search Report, dated Feb. 27, 2013, for PCT/US2012/065476, 3 pages.

International Search Report, dated Jan. 14, 2013, for PCT/US2012/052009, 3 pages.

International Search Report, dated Jul. 9, 2009 for PCT/US2009/043171, 5 pages.

International Search Report, dated Jun. 21, 2010, for PCT/US2009/064625, 3 pages.

International Search Report, dated Nov. 19, 2013 for PCT/US2013/052092, 4 pages.

International Search Report, dated Oct. 8, 2012 for PCT/US2012/033059, 3 pages.

Japanese Office Action, dated Jan. 6, 2015, for corresponding Japanese Application No. 2011-536564, 6 pages.

Kadirvel et al., "Self-Powered, Ambient Light Sensor Using bq25504," Texas Instruments, Application Report, SLUA629—Jan. 2012, 6 pages.

Korean Office Action with English Translation, dated May 16, 2016, for corresponding KR Application No. 10-2011-7014088, 22 pages.

Korean Office Action with English Translation, dated Nov. 18, 2015, for corresponding KR Application No. 10-2011-7014088, 14 pages.

Littelfuse, "Application Note: Protecting LEDs in Product Designs," 2009, 2 pages.

Notice of Allowance dated Apr. 11, 2014, for Reed, "Apparatus and Method of Energy Efficient Illumination," U.S. Appl. No. 13/943,537, 9 pages.

Notice of Allowance dated Apr. 11, 2016, for Reed, "High Efficiency Power Controller for Luminaire," U.S. Appl. No. 14/546,354, 5 pages.

Notice of Allowance dated Apr. 12, 2013, for Reed, "Apparatus and Method of Energy Efficient Illumination," U.S. Appl. No. 12/784,093, 9 pages.

Notice of Allowance dated Apr. 23, 2015, for Reed, "Electronic Control to Regulate Power for Solid-State Lighting and Methods Thereof," U.S. Appl. No. 12/619,535, 8 pages.

Notice of Allowance dated Apr. 27, 2015, for Reed et al., "Apparatus and Method of Operating a Luminaire," U.S. Appl. No. 13/558,191, 8 pages.

Notice of Allowance dated Aug. 29, 2014, for Reed et al., "Adjustable Output Solid-State Lamp with Security Features," U.S. Appl. No. 13/679,687, 9 pages.

Notice of Allowance dated Aug. 4, 2015, for Reed, "Solid State Lighting, Drive Circuit and Method of Driving Same," U.S. Appl. No. 13/875,000, 10 pages.

Notice of Allowance dated Feb. 25, 2016, for Reed, "Adjustable Output Solid-State Lighting Device," U.S. Appl. No. 13/707,123, 9 pages.

Notice of Allowance dated Jul. 1, 2014, for Reed, "Luminaire With Atmospheric Electrical Activity Detection and Visual Alert Capabilities," U.S. Appl. No. 13/786,114, 9 pages.

Notice of Allowance dated Jul. 18, 2016, for Reed et al., "Systems and Methods That Employ Object Recognition," U.S. Appl. No. 13/411,321, 15 pages.

Notice of Allowance dated Jul. 30, 2014, for Reed, "Apparatus and Method of Energy Efficient Illumination Using Received Signals," U.S. Appl. No. 13/085,301, 5 pages.

Notice of Allowance dated Jul. 7, 2014, for Reed et al., "Apparatus and Method for Schedule Based Operation of a Luminaire," U.S. Appl. No. 13/604,327, 8 pages.

(56) References Cited

OTHER PUBLICATIONS

Notice of Allowance dated Jun. 19, 2015, for Reed et al., "Apparatus and Method for Schedule Based Operation of a Luminaire" U.S. Appl. No. 14/552,274, 9 pages.
Notice of Allowance dated Jun. 20, 2014, for Reed et al., "Long-Range Motion Detection for Illumination Control," U.S. Appl. No. 12/784,080, 7 pages.
Notice of Allowance dated Mar. 16, 2017, for U.S. Appl. No. 14/552,274, Reed et al., "Apparatus and Method for Schedule Based Operation of a Luminaire," 9 pages.
Notice of Allowance dated May 23, 2013, for Reed, "Apparatus and Method of Energy Efficient Illumination," U.S. Appl. No. 12/784,091, 6 pages.
Notice of Allowance dated Nov. 18, 2015, for Reed, "Luminaire With Switch-Mode Converter Power Monitoring," U.S. Appl. No. 14/074,166, 9 pages.
Notice of Allowance dated Nov. 5, 2014, for Reed, "Apparatus and Method of Energy Efficient Illumination," U.S. Appl. No. 14/329,508, 10 pages.
Notice of Allowance dated Nov. 6, 2015, for Reed, "Systems, Methods, and Apparatuses for Using a High Current Switching Device As a Logic Level Sensor," U.S. Appl. No. 14/179,737, 9 pages.
Notice of Allowance dated Oct. 14, 2011, for Reed et al., "Low-Profile Pathway Illumination System," U.S. Appl. No. 12/437,472, 9 pages.
Notice of Allowance dated Sep. 12, 2013, for Reed, "Electrostatic Discharge Protection for Luminaire," U.S. Appl. No. 13/212,074, 6 pages.
Notice of Allowance dated Sep. 30, 2013, for Reed, "Resonant Network for Reduction of Flicker Perception in Solid State Lighting Systems," U.S. Appl. No. 13/592,590, 9 pages.
Office Action dated Apr. 15, 2016, for Reed, "Solid State Hospitality Lamp," U.S. Appl. No. 13/973,696, 11 pages.
Office Action dated Apr. 21, 2015, for Reed et al., "Remotely Adjustable Solid-State Lamp," U.S. Appl. No. 13/875,130, 10 pages.
Office Action dated Apr. 23, 2014, for Reed, "Apparatus and Method of Energy Efficient Illumination Using Received Signals," U.S. Appl. No. 13/085,301, 12 pages.
Office Action dated Apr. 24, 2013, for Reed, "Apparatus and Method of Energy Efficient Illumination," U.S. Appl. No. 12/784,091, 12 pages.
Office Action dated Aug. 14, 2014, for Reed, "Electronic Control to Regulate Power for Solid-State Lighting and Methods Thereof" U.S. Appl. No. 12/619,535, 16 pages.
Office Action dated Aug. 23, 2016, for Reed, "Apparatus and Method of Energy Efficient Illumination Using Received Signals," U.S. Appl. No. 14/557,275, 23 pages.
Office Action dated Aug. 25, 2014, for Reed et al., "Systems and Methods That Employ Object Recognition," U.S. Appl. No. 13/411,321, 35 pages.
Office Action dated Aug. 28, 2014, for Reed, "Apparatus and Method of Energy Efficient Illumination," U.S. Appl. No. 14/329,508, 8 pages.
Office Action dated Dec. 21, 2012, for Reed et al., "Long-Range Motion Detection for Illumination Control," U.S. Appl. No. 12/784,080, 26 pages.
Office Action dated Dec. 22, 2014, for Reed et al., "Apparatus and Method of Operating a Luminaire," U.S. Appl. No. 13/558,191, 17 pages.
Office Action dated Dec. 5, 2012, for Reed, "Apparatus and Method of Energy Efficient Illumination," U.S. Appl. No. 12/784,091, 18 pages.
Office Action dated Dec. 5, 2012, for Reed, "Apparatus and Method of Energy Efficient Illumination," U.S. Appl. No. 12/784,093, 13 pages.
Office Action dated Dec. 7, 2015, for Reed et al., "Systems and Methods That Employ Object Recognition," U.S. Appl. No. 13/411,321, 47 pages.
Office Action dated Feb. 17, 2017, for U.S. Appl. No. 14/939,856, Reed et al., "Luminaire with Adjustable Illumination Pattern," 13 pages.
Office Action dated Feb. 27, 2014, for Reed et al., "Adjustable Output Solid-State Lamp With Security Features," U.S. Appl. No. 13/679,687, 11 pages.
Office Action dated Feb. 28, 2013, for Reed, "Electronic Control to Regulate Power for Solid-State Lighting and Methods Thereof," U.S. Appl. No. 12/619,535, 17 pages.
Office Action dated Feb. 9, 2015, for Reed et al., "Systems and Methods That Employ Object Recognition," U.S. Appl. No. 13/411,321, 40 pages.
Office Action dated Jan. 18, 2017 for Reed, "Electronic Control to Regulate Power for Solid-State Lighting and Methods Thereof," U.S. Appl. No. 14/806,500, 18 pages.
Office Action dated Jan. 2, 2015, for Reed, "Adjustable Output Solid-State Lighting Device," U.S. Appl. No. 13/707,123, 24 pages.
Office Action dated Jan. 30, 2014, for Reed et al., "Long-Range Motion Detection For Illumination Control," U.S. Appl. No. 12/784,080, 26 pages.
Office Action dated Jul. 22, 2013, for Reed et al., "Long-Range Motion Detection for Illumination Control," U.S. Appl. No. 12/784,080, 29 pages.
Office Action dated Jul. 30, 2013, for Reed, "Electronic Control to Regulate Power for Solid-State Lighting and Methods Thereof,"U. S. Appl. No. 12/619,535, 15 pages.
Office Action dated Mar. 15, 2013 for Reed et al., "Electrostatic Discharge Protection for Luminaire," U.S. Appl. No. 13/212,074, 11 pages.
Office Action dated Mar. 2, 2015, for Reed et al., "Apparatus and Method for Schedule Based Operations of a Luminaire," U.S. Appl. No. 14/552,274, 7 pages.
Office Action dated Mar. 23, 2017, for Reed, "High Efficiency Power Controller for Luminaire," U.S. Appl. No. 15/206,019, 22 pages.
Office Action dated Mar. 26, 2014, for Reed et al., "Apparatus and Method for Schedule Based Operation of a Luminaire," U.S. Appl. No. 13/604,327, 10 pages.
Office Action dated Mar. 26, 2014, for Reed, "Electronic Control to Regulate Power for Solid-State Lighting and Methods Thereof," U.S. Appl. No. 12/619,535, 16 pages.
Office Action dated Mar. 4, 2016, for Reed et al., "Long-Range Motion Detection for Illumination Control," U.S. Appl. No. 14/500,512, 18 pages.
Office Action dated May 5, 2011, for Reed et al., "Low-Profile Pathway Illumination System," U.S. Appl. No. 12/437,472, 24 pages.
Office Action dated May 9, 2016 for Reed, "Electronic Control to Regulate Power for Solid-State Lighting and Methods Thereof," U.S. Appl. No. 14/806,500, 18 pages.
Office Action dated Nov. 27, 2013, for Reed, "Apparatus and Method of Energy Efficient Illumination," U.S. Appl. No. 13/943,537, 8 pages.
Office Action dated Oct. 1, 2013, for Reed, "Apparatus and Method of Energy Efficient Illumination Using Received Signals," U.S. Appl. No. 13/085,301, 11 pages.
Office Action dated Oct. 5, 2015, for Reed, "Adjustable Output Solid-State Lighting Device," U.S. Appl. No. 13/707,123, 24 pages.
Office Action dated Sep. 10, 2015, for Reed, "High Efficiency Power Controller for Luminaire," U.S. Appl. No. 14/546,354, 15 pages.
Office Action dated Sep. 17, 2015, for Reed et al., "Long-Range Motion Detection for Illumination Control," U.S. Appl. No. 14/500,512, 17 pages.
Office Action dated Sep. 19, 2016, for Reed et al., "Apparatus and Method for Schedule Based Operation of a Luminaire," U.S. Appl. No. 14/552,274, 9 pages.
Office Action dated Sep. 6, 2016 for Reed, "Electronic Control to Regulate Power for Solid-State Lighting and Methods Thereof," U.S. Appl. No. 14/806,500, 18 pages.
Panasonic Electronic Components, "LED Lighting Solutions," 2009, 6 pages.

(56) References Cited

OTHER PUBLICATIONS

Poplawski, "Exploring Flicker & LEDs," 2010 DOE SSL Market Introduction Workshop, U.S. Department of Energy, Jul. 22, 2010, 16 pages.
Reed et al., "Adjustable Output Solid-State Lamp with Security Features," Amendment filed Jun. 24, 2014, for U.S. Appl. No. 13/679,687, 11 pages.
Reed et al., "Adjustable Output Solid-State Lamp with Security Features," U.S. Appl. No. 61/561,616, filed Nov. 18, 2011, 33 pages.
Reed et al., "Apparatus and Method for Schedule Based Operation of a Luminaire" Amendment filed Dec. 7, 2016, for U.S. Appl. No. 14/552,274, 11 pages.
Reed et al., "Apparatus and Method for Schedule Based Operation of a Luminaire" Amendment filed Jun. 1, 2015, for U.S. Appl. No. 14/552,274, 14 pages.
Reed et al., "Apparatus and Method for Schedule Based Operation of a Luminaire," Amendment filed Jun. 7, 2016, for U.S. Appl. No. 14/552,274, 14 pages.
Reed et al., "Apparatus and Method for Schedule Based Operation of a Luminaire," Amendment filed Jun. 24, 2014, for U.S. Appl. No. 13/604,327, 14 pages.
Reed et al., "Apparatus and Method of Operating a Luminaire," Amendment filed Mar. 19, 2015, for U.S. Appl. No. 13/558,191, 20 pages.
Reed et al., "Long-Range Motion Detection for Illumination Control," Amendment filed Dec. 10, 2015, for U.S. Appl. No. 14/500,512, 18 pages.
Reed et al., "Long-Range Motion Detection for Illumination Control," Amendment filed Apr. 22, 2013, for U.S. Appl. No. 12/784,080, 17 pages.
Reed et al., "Long-Range Motion Detection for Illumination Control," Amendment filed Apr. 28, 2014, for U.S. Appl. No. 12/784,080, 20 pages.
Reed et al., "Long-Range Motion Detection for Illumination Control," Amendment filed Sep. 27, 2013, for U.S. Appl. No. 12/784,080, 20 pages.
Reed et al., "Long-Range Motion Detection for Illumination Control," U.S. Appl. No. 61/180,017, filed May 20, 2009, 32 pages.
Reed et al., "Low-Profile Pathway Illumination System," Amendment filed Jul. 29, 2011, for U.S. Appl. No. 12/437,472, 19 pages.
Reed et al., "Low-Profile Pathway Illumination System," U.S. Appl. No. 61/051,619, filed May 8, 2008, 25 pages.
Reed et al., "Remotely Adjustable Solid-State Lamp," Amendment filed Apr. 1, 2015, for U.S. Appl. No. 13/875,130, 14 pages.
Reed et al., "Remotely Adjustable Solid-State Lamp," Amendment filed Jul. 20, 2015, for U.S. Appl. No. 13/875,130, 15 pages.
Reed et al., "Remotely Adjustable Solid-State Lamp," U.S. Appl. No. 61/641,781, filed May 2, 2012, 65 pages.
Reed et al., "Systems and Methods That Employ Object Recognition," Amendment filed Jul. 7, 2015, for U.S. Appl. No. 13/411,321, 21 pages.
Reed et al., "Systems and Methods That Employ Object Recognition," Amendment filed Mar. 7, 2016, for U.S. Appl. No. 13/411,321, 16 pages.
Reed et al., "Systems and Methods That Employ Object Recognition," Amendment filed May 6, 2015, for U.S. Appl. No. 13/411,321, 20 pages.
Reed et al., "Systems and Methods That Employ Object Recognition," Amendment filed Nov. 21, 2014, for U.S. Appl. No. 13/411,321, 20 pages.
Reed et al., "Turbulent Flow Cooling for Electronic Ballast," U.S. Appl. No. 61/088,651, filed Aug. 13, 2008, 23 pages.
Reed, "Adjustable Output Solid-State Lighting Device," Amendment filed Jan. 8, 2016, for U.S. Appl. No. 13/707,123, 11 pages.
Reed, "Adjustable Output Solid-State Lighting Device," Amendment filed Apr. 2, 2015, for U.S. Appl. No. 13/707,123, 14 pages.
Reed, "Adjustable Output Solid-State Lighting Device," U.S. Appl. No. 61/567,308, filed Dec. 6, 2011, 49 pages.
Reed, "Ambient Light Control in Solid State Lamps and Luminaires," Amendment filed Jan. 29, 2015, for U.S. Appl. No. 14/609,168, 12 pages.
Reed, "Ambient Light Control in Solid State Lamps and Luminaires," U.S. Appl. No. 61/933,733, filed Jan. 30, 2014, 8 pages.
Reed, "Apparatus and Method of Energy Efficient Illumination Using Received Signals," Amendment filed Jan. 2, 2014, for U.S. Appl. No. 13/085,301, 26 pages.
Reed, "Apparatus and Method of Energy Efficient Illumination Using Received Signals," Amendment filed Jul. 23, 2014, for U.S. Appl. No. 13/085,301, 12 pages.
Reed, "Apparatus and Method of Energy Efficient Illumination," U.S. Appl. No. 61/346,263, filed May 19, 2010, 67 pages.
Reed, "Apparatus and Method of Energy Efficient Illumination," Amendment filed Apr. 2, 2013, for U.S. Appl. No. 12/784,093, 13 pages.
Reed, "Apparatus and Method of Energy Efficient Illumination," Amendment filed Apr. 4, 2013, for U.S. Appl. No. 12/784,091, 15 pages.
Reed, "Apparatus and Method of Energy Efficient Illumination," Amendment filed May 14, 2013, for U.S. Appl. No. 12/784,091, 9 pages.
Reed, "Apparatus and Method of Energy Efficient Illumination," Amendment filed Sep. 30, 2014, for U.S. Appl. No. 14/329,508, 18 pages.
Reed, "Apparatus and Method of Energy Efficient Illumination," U.S. Appl. No. 61/333,983, filed May 12, 2010, 57 pages.
Reed, "Electronic Control to Regulate Power for Solid-State Lighting and Methods Thereof," Amendment filed Dec. 15, 2014, for U.S. Appl. No. 12/619,535, 21 pages.
Reed, "Electronic Control to Regulate Power for Solid-State Lighting and Methods Thereof," Amendment filed May 24, 2013, for U.S. Appl. No. 12/619,535, 21 pages.
Reed, "Electronic Control to Regulate Power for Solid-State Lighting and Methods Thereof," Amendment filed May 27, 2014, for U.S. Appl. No. 12/619,535, 22 pages.
Reed, "Electronic Control to Regulate Power for Solid-State Lighting and Methods Thereof," Amendment filed Oct. 30, 2013, for U.S. Appl. No. 12/619,535, 5 pages.
Reed, "Electronic Control to Regulate Power for Solid-State Lighting and Methods Thereof," Response Under 37 CFR 1.116 filed Dec. 5, 2016 for U.S. Appl. No. 14/806,500, 12 pages.
Reed, "Electronic Control to Regulate Power for Solid-State Lighting and Methods Thereof," U.S. Appl. No. 61/115,438, filed Nov. 17, 2008, 51 pages.
Reed, "Electronic Control to Regulate Power for Solid-State Lighting and Methods Thereof," U.S. Appl. No. 61/154,619, filed Feb. 23, 2009, 62 pages.
Reed, "Electrostatic Discharge Protection for Luminaire," Amendment filed Jun. 17, 2013, for U.S. Appl. No. 13/212,074, 11 pages.
Reed, "High Efficiency Power Controller for Luminaire," Amendment filed Feb. 9, 2016, for U.S. Appl. No. 14/546,354, 11 pages.
Reed, "High Efficiency Power Controller for Luminaire," U.S. Appl. No. 61/905,699, filed Nov. 18, 2013, 5 pages.
Reed, "Low Power Photocontrol for Luminaire," U.S. Appl. No. 62/137,666, filed Mar. 24, 2015, 36 pages.
Reed, "Luminaire with Atmospheric Electrical Activity Detection and Visual Alert Capabilities," U.S. Appl. No. 61/649,159, filed Aug. 28, 2012, 52 pages.
Reed, "Luminaire with Switch-Mode Converter Power Monitoring," U.S. Appl. No. 61/723,675, filed Nov. 7, 2012, 73 pages.
Reed, "Photocontrol for Luminaire Consumes Very Low Power," U.S. Appl. 61/849,841, filed Jul. 24, 2013, 41 pages.
Reed, "Resonant Network for Reduction of Flicker Perception in Solid State Lighting Systems," U.S. Appl. No. 61/527,029, filed Aug. 24, 2011, 41 pages.
Reed, "Solid State Hospitality Lamp," U.S. Appl. No. 61/692,619, filed Aug. 23, 2012, 32 pages.
Reed, "Solid State Lighting, Drive Circuit and Method of Driving Same," U.S. Appl. No. 61/640,963, filed May 1, 2012, 24 pages.
Reed, "Systems, Methods, and Apparatuses for Using a High Current Switching Device as a Logic Level Sensor," U.S. Appl. No. 61/764,395, filed Feb. 13, 2013, 48 pages.

(56) References Cited

OTHER PUBLICATIONS

Reed, "Luminaire with Adjustable Illumination Pattern," U.S. Appl. No. 62/114,826, filed Feb. 11, 2015, 68 pages.
Renesas Electronics, "Zener Diodes for Surge Absorption—Applications of high-intensity LED," Apr. 2010, 1 page.
Tyco Electronics, "Circuit Protection," retrieved Jun. 10, 2011, retrieved from http://www.tycoelectronics.com/en/products/circuit-protection.html, 2 pages.
Written Opinion, dated Nov. 11, 2014, for International Application No. PCT/US2014/047867, 5 pages.
Written Opinion, dated Dec. 13, 2010 for PCT/US2010/035649, 4 pages.
Written Opinion, dated Dec. 15, 2010 for PCT/US2010/035658, 3 pages.
Written Opinion, dated Dec. 28, 2010 for PCT/US2010/035651, 3 pages.
Written Opinion, dated Dec. 30, 2013 for PCT/US2013/058266, 8 pages.
Written Opinion, dated Feb. 27, 2013, for PCT/US2012/065476, 8 pages.
Written Opinion, dated Jan. 14, 2013, for PCT/US2012/052009, 5 pages.
Written Opinion, dated Jul. 9, 2009 for PCT/US2009/043171, 8 pages.
Written Opinion, dated Jun. 21, 2010 for PCT/US2009/064625, 5 pages.
Written Opinion, dated Nov. 19, 2013 for PCT/US2013/052092, 7 pages.
Written Opinion, dated Oct. 8, 2012 for PCT/US2012/033059, 3 pages.

* cited by examiner

LUMINAIRE DIMMING MODULE USES 3 CONTACT NEMA PHOTOCONTROL SOCKET

BACKGROUND

Technical Field

The present disclosure is related to lighting, and in particular to retrofits for legacy outdoor lights or luminaires, for instance street lights, lights in parking lots and other area lighting or luminaries.

Description of the Related Art

It is desirable to be able to dim the intensity of solid state luminaires, for example street and area lights, using wireless or Power Line Carrier control systems. A NEMA standard socket with 5 or 7 contacts is often used for this purpose. Traditional 3 contact NEMA sockets have been used with "Dusk to Dawn" photocontrols which are only able to turn the luminaire ON or OFF.

BRIEF SUMMARY

A dimmer plug that is coupleable to a three contact socket of a luminaire, the three contact socket having three female receptacles, may be summarized as including a housing having a first face; only three male electrical contacts, the three male electrical contacts which extend from the first face of the housing, and arranged with respect to one another in a first arrangement; a receiver housed by the housing and operable to receive input signals; and circuitry housed by the housing and communicatively coupled to the receiver, the circuitry operable to provide an output signal via one of the three male electrical contacts based on the input signals received by the receiver. Circuitry may control dimming of the luminaire without controlling a line power of the luminaire. Circuitry may produce the output signal as a pulse-width modulated signal. Circuitry may adjust a duty cycle of the pulse-width modulated signal to adjust a level of illumination produced by the luminaire. Circuitry may produce the output signal as a frequency modulated signal. Circuitry may produce the output signal as a digitally coded signal. Circuitry may produce the output signal as an analog signal with a range of 0 volts to 100 volts.

The receiver may be a radio receiver and may further include an antenna communicatively coupled to the radio receiver to wirelessly receive the input signals. The receiver may be a wire-line receiver electrically coupled to receive the input signals via an electrical power line coupled to the luminaire. The three male electrical contacts may include an AC line contact, an AC neutral contact, and a control signal contact. The only three male electrical contacts may be sized, dimensioned, shaped, and may be arranged with respect to one another according to fit a socket that complies with a National Electrical Manufacturer Association (NEMA) C136 specification, such as the NEMA C136.10 specification, in existence as of Jan. 1, 2016. The dimmer plug may be a twist lock plug. The housing may have a thickness and a second face, the second face opposed across the thickness of the housing from the first face, and the housing may include a plurality of female electrical contacts accessible from the second face, the female electrical contacts electrically coupled to the circuitry. The housing may include either five or seven electrical contacts accessible from the second face. The five or seven electrical contacts may be sized, dimensioned, shaped and arranged to receive at least one of a five position dimming controller and a seven position dimming controller. The housing may include a plurality of pad electrical contacts accessible from the second face. The circuitry may receive the input signals from the dimming controller.

The dimmer plug may further include a light sensor communicatively coupled to the circuitry to provide the circuitry with an electrical signal representative of light sensed by the light sensor. The light sensor may include at least one of either a photo-sensor, a photodetector, and a photo-diode.

A dimmer plug that is coupleable to a three contact socket of a luminaire, the three contact socket having three female receptacles may be summarized as including: a housing having a first face; only three male electrical contacts, the three male electrical contacts which extend from the first face of the housing, and arranged with respect to one another in a first arrangement; a receiver housed by the housing and operable to receive an input signal that is not obtained from a light sensor; and circuitry housed by the housing and communicatively coupled to the receiver, the circuitry operable to provide an output signal via one of the three male electrical contacts based on the input signals received by the receiver.

The circuitry may be operable to control dimming of the luminaire without controlling a line power of the luminaire. The input signal received by the receiver may be not representative of a level of light in an external environment, and the circuitry may be operable to control dimming of the luminaire based at least in part on the input signal that is not representative of a level of light in the external environment.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION

Figure 1:
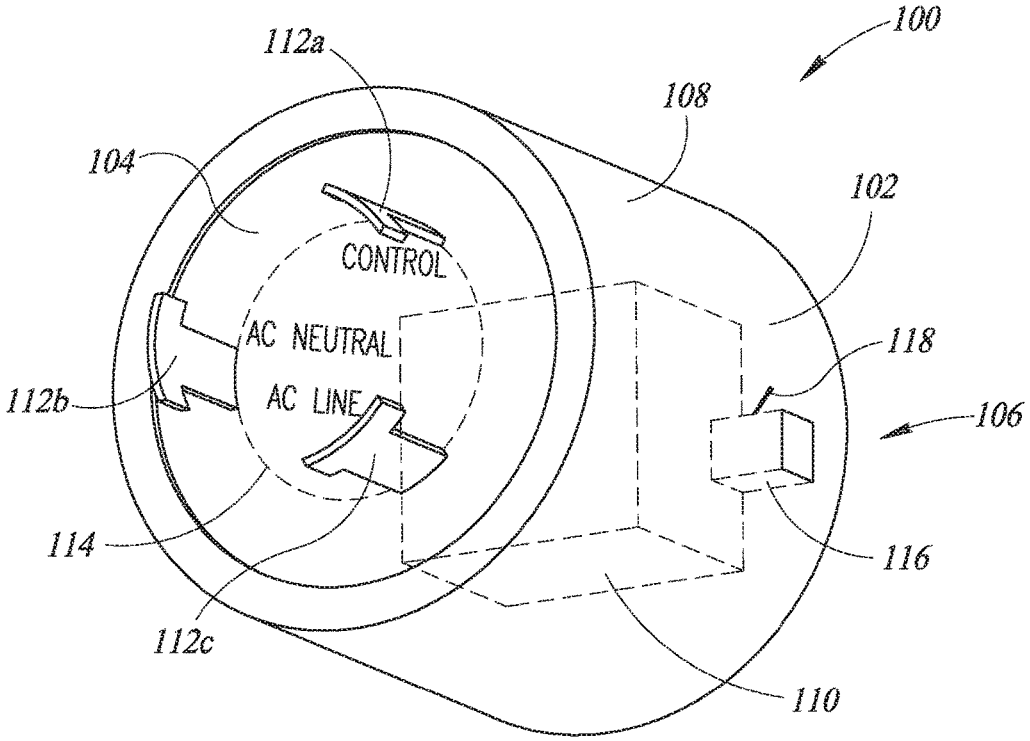
FIG. 1 is an isometric view of a dimmer plug which houses a receiver, and which has three contacts, according to at least one illustrated implementation.

FIG. 1 shows a dimmer plug 100 that removably plugs into a 3 contact socket, according to at least one illustrated implementation.

The dimmer plug 100 may comprise a 3 contact socket that complies with a specific standard or specification. For example, the dimmer plug 100 may comprise a 3 contact socket that complies with a National Electrical Manufacturer Association (NEMA) standard or specification or an American National Standards Institute (ANSI) standard or specification, for instance the ANSI C136.10 standard or specification, in existence as of Jan. 1, 2016. The dimmer plug 100 includes a body or housing 102 that houses a dimming circuit 110 and a receiver 116, the receiver communicatively coupled to the dimming circuit 110. The dimming circuit 110 provides dimming of a luminaire to which the dimmer plug 100 is attached, without controlling the line power to the luminaire.

The dimmer plug body or housing 102 has a first face 104 and a second face 106 opposed across a thickness of the body or housing 102 from the first face 104. The body or housing 102 may include one or more side walls 108 that extend between the first and the second faces 104, 106, respectively. In some implementations, the side wall 108 may have an annular cross-section, the housing 108 being cylindrical with the first face 104 at one end of the cylinder and the second face 106 at a second end of the cylinder. The body or housing 102 is not limited to circular profiles, and may have an oval, rectangular, hexagonal or even a free-form profile.

Three male electrical contacts 112*a*, 112*b*, 112*c* (collectively, male electrical contacts 112) may extend perpendicularly from the first face 104. A first one of the male electrical contacts 112*a*, denominated as control signal contact 112*a*, may be used to provide an output control signal that controls whether the lighting element in the luminaire is turned ON or turned OFF. In a conventional three-prong photocontroller plug, the control signal contact may provide an AC switch line signal that turns the light source in the luminaire ON at dusk and OFF at dawn, in response to ambient light sensed by a light sensor. As used in the dimmer plug 100, the control signal contact 112*a* may be used to provide a control signal that selectively cycles the light source in the luminaire ON and OFF to effectively dim the light output of the light source by a selected amount. The second male electrical contact, denominated as AC neutral contact 112*b*, may provide a connection to the AC neutral line. The third male electrical contact, denominated as AC line contact 112*c*, may provide a connection to the AC line. The AC neutral contact 112*b* and the AC line contact 112*c* may be electrically coupled to a power line and provide electrical power to the luminaire and/or to the dimmer plug 100.

The male electrical contacts 112 may be arranged with respect to each other in a first arrangement. For example, in some implementations, the male electrical contacts 112 may be spaced at equal distances around a circular region 114 included within the first face 104. In some implementations, the male electrical contacts 112 may be sized, dimensioned, shaped, and arranged with respect to each other in order to fit into a socket that complies with a NEMA or ANSI specification or standard, such as the ANSI C136.10 specification or standard in existence on Jan. 1, 2016. In such an implementation, the dimmer plug 100 may fit into a luminaire socket having three complementary female receptacles that correspond to the three male electrical contacts 112. In some implementations, the dimmer plug 100 may comprise a twist-lock plug in which the male electrical contacts 112 may be inserted into and twisted with respect to the corresponding female receptacles to thereby physically securely lock the dimmer plug 100 with the luminaire socket. The twist-lock dimmer plug 100 may be selectively releasable from the luminaire socket, for example by twisting in an opposite direction from the direction used to secure the twist-lock dimmer plug 100 to the luminaire socket.

The dimming circuit 110 may be housed by the body or housing 102, for example enclosed therein. The body or housing 102 may be electrically insulative and may provide environmental protection to the dimming circuit 110. The dimming circuit 110 may include a processor and/or microprocessor and/or micro-controller that execute machine-executable instructions. The dimming circuit 110 may also include one or more non-transitory memories that may store one or more lighting and/or dimming programs operable, when executed by the processor within the dimming circuit 110, to dim the luminaire without controlling the line power provided to the luminaire by, e.g., the AC line signal and AC neutral signal provided from the power line. For example, in some implementations, the dimming circuit 110 may be operable to provide a dimming level signal via the control signal contact 112*a*. Such a dimming level signal may, for example, be in the form of a pulse width modulated signal, an analog signal, a frequency modulated signal or a digitally coded signal such as ANSCI serial protocol compliant signal, that selectively turns the light source in the luminaire on and off, as discussed below.

The dimming circuit 110 may be electrically and communicatively coupled to a receiver 116 that may be operable to receive input signals that are associated with and indicate specific output signals for effectively dimming the light source of a luminaire. For example, in one embodiment, a Power Line Carrier receiver is coupled to the input power lines and receives the input signals from a remote source, for example from a central network controller. The Power Line Carrier receiver may provide the input signals to the dimming circuit 110 to provide the appropriate output control signals. In some implementations, the input signals may be received by a radio wireless receiver 116 such as a WiFi or Bluetooth radio transceiver that includes an antenna 118. The radio wireless receiver may provide the input signals to the dimming circuit 110 to provide the appropriate output control signals.

In any implementation, the receiver 116 of the dimmer plug 100 receives the transmitted input signal, and the circuitry of the dimming circuit 110 (e.g., analog logic circuitry, digital microcontroller or microprocessor) and/or the instructions executed by the dimming circuit 110 provide an output signal based on the received input signal. For example, in at least some implementations, the input signal received by the receiver 116 is provided to a high voltage solid state switch (e.g., MOSFET, IGBT). The high voltage solid state switch may use analog logic circuitry or digital logic (e.g., a microcontroller) to provide a pulse width modulated signal with a defined period (e.g., 4 seconds) and a voltage level equal to the line voltage based on a dimming level command included within the received input signal.

Figure 2:
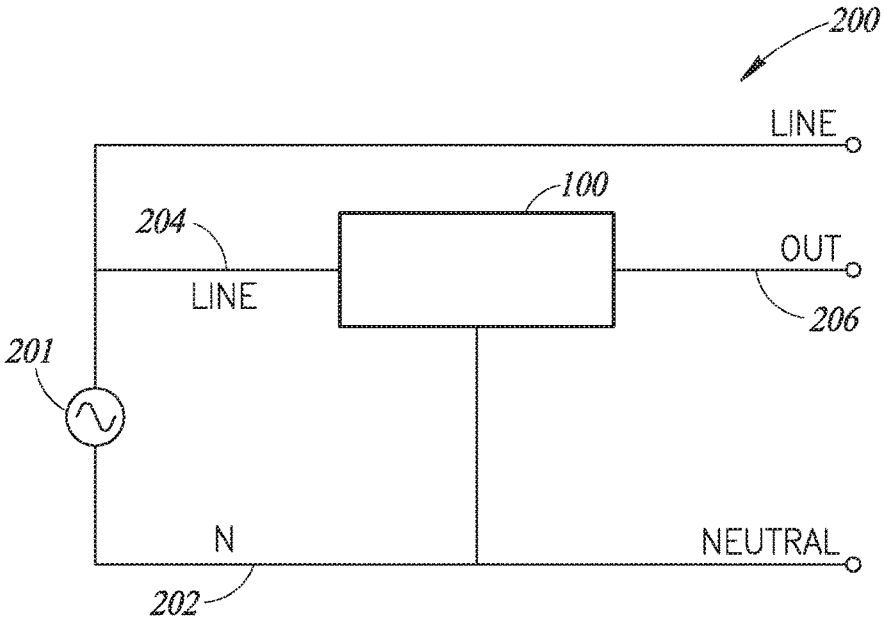
FIG. 2 is a circuit schematic illustrating the dimmer plug in a circuit with an AC power source, according to at least one illustrated implementation.

FIG. 2 shows a circuit 200 which includes a dimmer plug 100 electrically coupled to an AC power source 201. The dimmer plug 100 receives the AC neutral input from AC neutral input line 202 and the AC line signal from the AC line 204 as inputs. The dimming circuit 110 (FIG. 1) may produce an output signal to be provided via an output line 206 to the control signal contact 112*a* based at least in part on a dimming level command received in a control signal, as discussed above.

Figure 3:
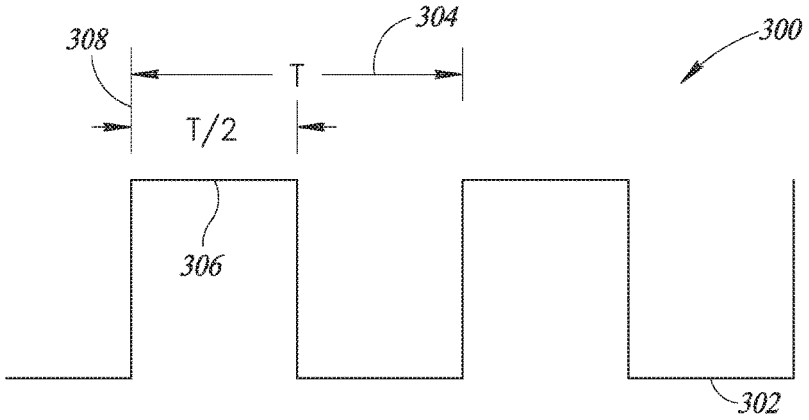
FIG. 3 is a timing diagram showing a representative pulse width modulated signal produced by the dimmer plug, according to at least one illustrated implementation.

FIG. 3 shows a timing diagram 300 for an output signal 302 in the form of a pulse width modulated signal. In such an implementation, the dimmer plug 100 and dimming circuit 110 outputs, for example, a pulse width modulated signal as an output signal 302 wherein the dimming level is proportional to the pulse width of a constant period 304, for example a period of 4 seconds. In this example, a high pulse 306 that lasts for a duty cycle 308 of two (2) seconds represents approximately a dimming level of 50% of full brightness. In this example, a constant high signal causes the luminaire to operate at full brightness, and a constant low signal causes the luminaire to operate at 0 brightness (full OFF). In such an implementation, the amount of dimming for the luminaire may be adjusted by adjusting the duration of the duty cycle 308 in proportion to the duration of the pulse width 304.

In one implementation, the output signal provided via the control signal contact 112*a* is an analog signal with a range of 0 volts to 10 volts. In another implementation, the output signal provided via the control signal contact 112*a* is an analog signal with a range of 0 volts to 100 volts.

Figure 4:
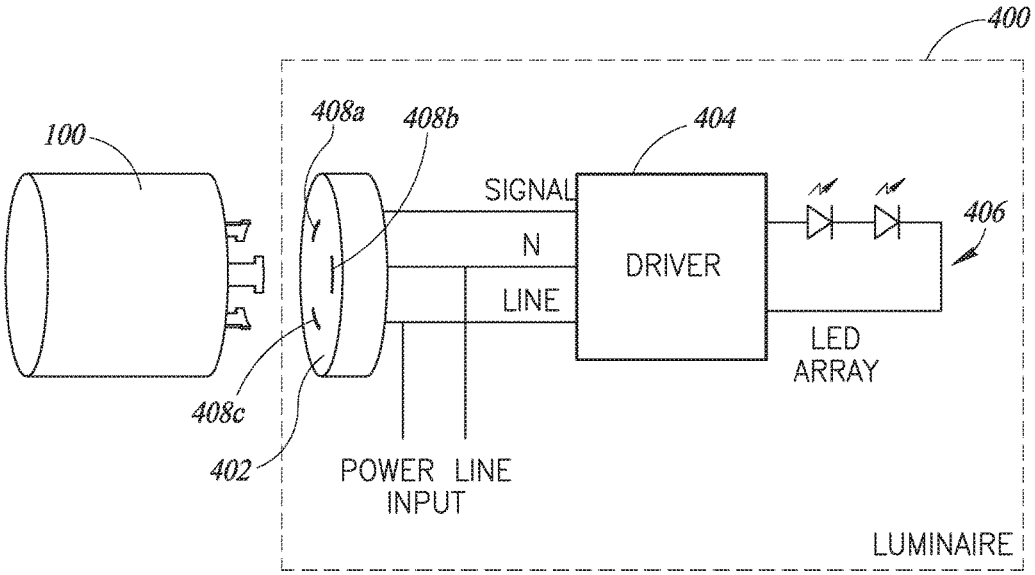
FIG. 4 is a schematic diagram showing the dimmer plug coupled to a luminaire, according to at least one illustrated implementation.

FIG. 4 shows a dimmer plug 100 and a luminaire 400, the luminaire having an LED driver 404, a light source 406, and a standard socket 402 to which the dimmer plug 100 mechanically and electrically mates or interfaces. The socket 402 may include three female receptacles (collectively, female receptacles 408) that are sized, spaced, dimensioned and arranged to securely, electrically couple with a dimmer plug 100 that has three complementary male contacts 112. The first female receptacle may correspond to a power source input receptacle 408*a* for a standard three-prong photocontrol unit. The power source input receptacle 408*a* may be electrically coupled to a control input on the driver 404, wherein the driver 404 includes circuitry that may be operable to selectively turn the light source 406 ON and OFF in response to the signal received via the power source input receptacle 408*a*. The luminaire 400 may have a high impedance input, for example 1 meg ohms, which couples the output signal received via the power source input receptacle 408*a* to the power converter part of the luminaire, for example, the LED driver 404.

The second female receptacle may correspond to the AC neutral line receptacle 408*b* that may be used to supply the signal from the AC neutral line to the dimmer plug 100. The third female receptacle may correspond to the AC line receptacle 408*c* that may be used to supply the AC line signal to the dimmer plug 100. As noted previously, the signal received via the power source input receptacle 408*a* may be used to control a dimming level for the light source 406 without controlling the line power input to the luminaire 400 via the AC neutral line receptacle 408*b* and the AC line receptacle 408*c*.

Figure 5:
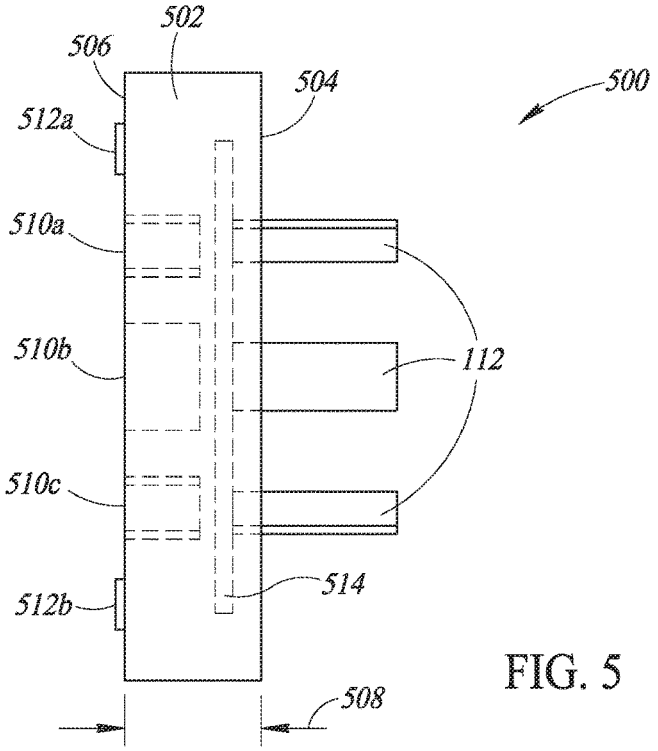
FIG. 5 is a side elevational view of a dimmer plug with at least some of the interior components illustrated in broken line, according to at least one illustrated implementation.

FIG. 5 shows a dimmer plug 500 with broken lines to denote internal components. The dimmer plug 500 may be placed between a five-contact photocontrol unit, a seven-contact photocontrol unit, or similar a photocontrol unit with more than three contacts, and a luminaire 400 that has a standard three-contact socket 402. The dimmer plug 500 includes a housing 502 that has a first face 504 and an opposing second face 506 that are separated by a thickness 508. One or more side walls 510 expand across the thickness 508 to connect the first face 504 and the second face 506. The first face 504 includes the three male electrical contacts 112 as discussed above. The second face 506 includes a plurality of electrical contacts that are sized, shaped, and dimensioned to electrically couple with other configurations of photocontrol units that may have more than three contacts. In some implementations, as least some of the electrical contacts on the second face 506 may include one or more female contacts, such as female contacts 510*a*, 510*b*, and 510*c* (collectively, female receptacles 510). In some implementations, at least some of the electrical contacts on the second face 506 may be pad contacts, such as pad contacts 512*a* and 512*b* (collectively, pad contacts 512). Such pad contacts 512 may be included on or proximate the surface of the second face 506 and make electrical contact with corresponding, complementary pad contacts included, for example, on the corresponding surface of a photocontrol unit.

The second face 506 may have any combination of female receptacles 510 and pad contacts 512. In some implementations, for example, all of the electrical contacts on the second face may be female contacts 510. In other implementations, all of the contacts on the second face may be pad contacts 512. In yet other implementations, the contacts may be a combination of female contacts 510 and pad contacts 512. In some implementations, for example, the second face 506 of the dimmer plug 500 may include three female contacts 510 that may be used to connect to male contacts of older, legacy photocontrol units. Such a second face 506 may include additional pad contacts 512 that may be used for additional functionality provided by relatively newer photocontrol units. For example, in some implementations, the female receptacles 510 and/or pad contacts 512 may be sized, spaced, and dimensioned on the second face 506 to electrically and communicatively couple to corresponding electrical contacts (e.g., male connectors and pad contacts) on a five-position and/or a seven-position dimming controller.

The housing 502 may enclose or house a dimming control circuit 514. In some implementations, the dimming control circuit 514 may be operable to receive dimming control signals input by a photocontrol unit electrically and communicatively coupled to the female contacts 510 and/or pad contacts 512 on the second face 506 of the dimmer plug 500. The dimming control circuit 514 may produce an output signal that can be provided via the control signal contact 112*a* to selectively dim the light output of the luminaire 400 with a three-receptacle socket 402 based at least in part on the dimming control signals received from the five-contact or the seven-contact dimming controller. The light output of the light source 406 on such a luminaire 400 may be controllably, selectively dimmed according to the control signal received via the control signal contact 112*a* using the techniques described above.

Figure 6:
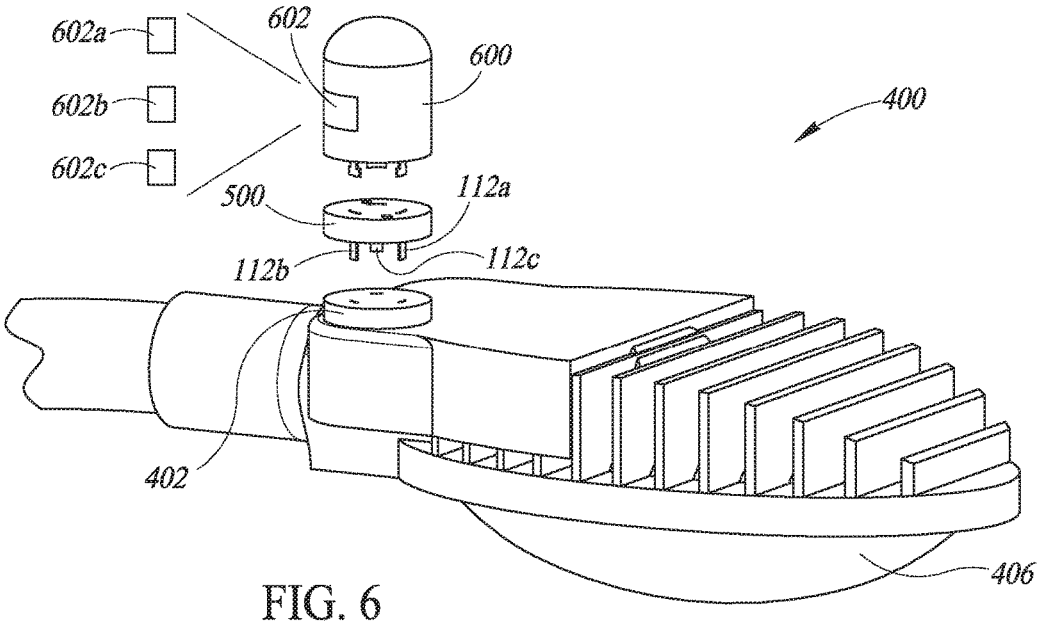
FIG. 6 is an isometric view of a luminaire that includes a covered light source and a three-prong socket, along with a corresponding dimmer plug and five-contact and/or seven-contact dimmer controller, according to at least one illustrated implementation.

FIG. 6 shows the luminaire 400 that includes a covered light source 406 and a three-prong socket 402, along with a corresponding dimmer plug 500 and five-contact and/or seven-contact dimmer photocontrol unit 600. The dimmer photocontrol unit 600 may include a light sensor 602 that includes one or more of a photo-sensor 602*a*, a photodetector 602*b*, and/or a photo-diode 602*c*. The light sensor 602 may produce an electrical signal representative of the amount of light sensed or detected by the light sensor 602. In such an implementation, the voltage level of the electrical signal may be used to indicate a desired dimming level of the covered light source 406.

The dimmer plug 500 may produce a dimming control signal based on the dimming signals received from the five-contact and/or seven-contact dimmer photocontrol unit 600. The dimming control signal may be input via the control signal contact 112*a* to controllably dim the light source 406 in the luminaire 400 that has a socket 402 configured to receive a three-pin dimmer plug. As such, the light output of the covered light source 406 may be dimmed without controlling the line power for the luminaire 400. In some implementations, for example, the five-contact and/or seven-contact dimmer photocontrol unit 600 may transmit a dimming level control signal that is between zero volts and ten volts. The voltage level of the dimming level control signal may indicate the desired dimming level and/or light intensity (e.g., a voltage level of 7 volts out of 10 volts may indicate 70% light intensity and 30% dimming). In such an implementation, the dimming control circuit 514 (FIG. 5) may be operable produce a pulse-width modulated signal that is input to the control signal contact on the three-prong socket 402 to cause the desired level of dimming on the luminaire 400 based at least in part on the dimming level control signal received from the five-contact and/or seven-contact dimmer photocontrol unit 600, as discussed above.

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 61/052,924, filed May 13, 2008; U.S. Pat. No. 8,926,138, issued Jan. 6, 2015; PCT Publication No. WO2009/140141, published Nov. 19, 2009; U.S. Provisional Patent Application No. 61/051,619, filed May 8, 2008; U.S. Pat. No. 8,118,456, issued Feb. 21, 2012; PCT Publication No. WO2009/137696, published Nov. 12, 2009; U.S. Provisional Patent Application No. 61/088,651, filed Aug. 13, 2008; U.S. Pat. No. 8,334,640, issued Dec. 18, 2012; U.S. Provisional Patent Application No. 61/115,438, filed Nov. 17, 2008; U.S. Provisional Patent Application No. 61/154,619, filed Feb. 23, 2009; U.S. Patent Publication No. 2010/0123403, published May 20, 2010; U.S. Non-provisional Patent Application No. 14/806,500, filed Jul. 22, 2015; PCT Publication No. WO2010/057115, published May 20, 2010; U.S. Provisional Patent Application No. 61/174,913, filed May 1, 2009; U.S. Pat. No. 8,926,139, issued Jan. 6, 2015; PCT Publication No. WO2010/127138, published November 4, 2010; U.S. Provisional Patent Application No. 61/180,017, filed May 20, 2009; U.S. Pat. No. 8,872,964, issued Oct. 28, 2014; U.S. Patent Publication No. 2015/0015716, published Jan. 15, 2015; PCT Publication No. WO2010/135575, published Nov. 25, 2010; U.S. Provisional Patent Application No. 61/229,435, filed Jul. 29, 2009; U.S. Patent Publication No. 2011/0026264, published Feb. 3, 2011; U.S. Provisional Patent Application No. 61/295,519, filed Jan. 15, 2010; U.S. Provisional Patent Application No. 61/406,490, filed Oct. 25, 2010; U.S. Pat. No. 8,378,563, issued Feb. 19, 2013; PCT Publication No. WO2011/088363, published Jul. 21, 2011; U.S. Provisional Patent Application No. 61/333,983, filed May 12, 2010; U.S. Pat. No. 8,541,950, issued Sep. 24, 2013; PCT Publication No. WO2010/135577, published Nov. 25, 2010; U.S. Provisional Patent Application No. 61/346,263, filed May 19, 2010; U.S. Pat. No. 8,508,137, issued Aug. 13, 2013; U.S. Pat. No. 8,810,138, issued Aug. 19, 2014; U.S. Pat. No. 8,987,992, issued Mar. 24, 2015; PCT Publication No. WO2010/135582, published Nov. 25, 2010; U.S. Provisional Patent Application No. 61/357,421, filed Jun. 22, 2010; U.S. Patent Publication No. 2011/0310605, published Dec. 22, 2011; PCT Publication No. WO2011/163334, published Dec. 29, 2011; U.S. Pat. No. 8,901,825, issued Dec. 2, 2014; U.S. Patent Publication No. 2015/0084520, published Mar. 26, 2015; PCT Publication No. WO2012/142115, published Oct. 18, 2012; U.S. Pat. No. 8,610,358, issued Dec. 17, 2013; U.S. Provisional Patent Application No. 61/527,029, filed Aug. 24, 2011; U.S. Pat. No. 8,629,621, issued Jan. 14, 2014; PCT Publication No. WO2013/028834, published Feb. 28, 2013; U.S. Provisional Patent Application No. 61/534,722, filed Sep. 14, 2011; U.S. Patent Publication No. 2013/0062637, published Mar. 14, 2013; PCT Publication No. WO2013/040333, published Mar. 21, 2013; U.S. Provisional Patent Application No. 61/567,308, filed Dec. 6, 2011; U.S. Patent Publication No. 2013/0163243, published Jun. 27, 2013; U.S. Provisional Patent Application No. 61/561,616, filed Nov. 18, 2011; U.S. Patent Publication No. 2013/0141010, published Jun. 6, 2013; PCT Publication No. WO2013/074900, published May 23, 2013; U.S. Provisional Patent Application No. 61/641,781, filed May 2, 2012; U.S. Patent Publication No. 2013/0293112, published Nov. 7, 2013; U.S. Patent Publication No. 2013/0229518, published Sep. 5, 2013; U.S. Provisional Patent Application No. 61/640,963, filed May 1, 2012; U.S. Patent Publication No. 2013/0313982, published Nov. 28, 2013; U.S. Patent Publication No. 2014/0028198, published Jan. 30, 2014; U.S. Non-provisional patent application Ser. No. 14/816,754, filed Aug. 3, 2015; PCT Publication No. WO2014/018773, published Jan. 30, 2014; U.S. Provisional Patent Application No. 61/723,675, filed Nov. 7, 2012; U.S. Patent Publication No. 2014/0159585, published Jun. 12, 2014; U.S. Provisional Patent Application No. 61/692,619, filed Aug. 23, 2012; U.S. Patent Publication No. 2014/0055990, published Feb. 27, 2014; U.S. Provisional Patent Application No. 61/694,159, filed Aug. 28, 2012; U.S. Pat. No. 8,878,440, issued Nov. 4, 2014; U.S. Patent Publication No. 2014/0062341, published Mar. 6, 2014; U.S. Patent Publication No. 2015/0077019, published Mar. 19, 2015; PCT Publication No. WO2014/039683, published Mar. 13, 2014; U.S. Provisional Patent Application No. 61/728,150, filed Nov. 19, 2012; U.S. Patent Publication No. 2014/0139116, published May 22, 2014; U.S. Non-provisional patent application Ser. No. 14/950,823, filed Nov. 24, 2015; PCT Publication No. WO2014/078854, published May 22, 2014; U.S. Provisional Patent Application No. 61/764,395, filed Feb. 13, 2013; U.S. Patent Publication No. 2014/0225521, published Aug. 14, 2014; U.S. Provisional Patent Application No. 61/849,841, filed Jul. 24, 2013; U.S. Patent Publication No. 2015/0028693, published Jan. 29, 2015; PCT Publication No. WO2015/013437, published Jan. 29, 2015; U.S. Provisional Patent Application No. 61/878,425, filed Sep. 16, 2013; U.S. Patent Publication No. 2015/0078005, published Mar. 19, 2015; PCT Publication No. WO2015/039120, published Mar. 19, 2015; U.S. Provisional Patent Application No. 61/933,733, filed Jan. 30, 2014; U.S. Pat. No. 9,185,777, issued Nov. 10, 2015; PCT Publication No. WO2015/116812, published Aug. 6, 2015; U.S. Provisional Patent Application No. 61/905,699, filed Nov. 18, 2013; U.S. Patent Publication No. 2015/0137693, published May 21, 2015; U.S. Provisional Patent Application No. 62/068,517, filed Oct. 24, 2014; U.S. Provisional Patent Application No 62/183,505, filed Jun. 23, 2015; U.S. Non-provisional patent application Ser. No. 14/869,492, filed Sep. 29, 2015; PCT Application No. PCT/US2015/53000, filed Sep. 29, 2015; U.S. Provisional Patent Application No. 62/082,463, filed Nov. 20, 2014; U.S. Non-provisional patent application Ser. No. 14/869,501, filed Sep. 29, 2015;

PCT Application No. PCT/US2015/53006, filed Sep. 29, 2015; U.S. Provisional Patent Application No. 62/057,419, filed Sep. 30, 2014; U.S. Non-provisional patent application Ser. No. 14/869,511, filed Sep. 29, 2015; PCT Application No. PCT/US2015/53009, filed Sep. 29, 2015; U.S. Provisional Patent Application No. 62/114,826, filed Feb. 11, 2015; U.S. Non-provisional patent application Ser. No. 14/939,856, filed Nov. 12, 2015; U.S. Provisional Patent Application No. 62/137,666, filed Mar. 24, 2015; U.S. Non-provisional patent application Ser. No. 14/994,569, filed Jan. 13, 2016; U.S. Non-provisional patent application Ser. No. 14/844,944, filed Sep. 3, 2015; U.S. Provisional Patent Application No. 62/208,403, filed Aug. 21, 2015; U.S. Provisional Patent Application No. 62/264,694, filed Dec. 8, 2015 are incorporated herein by reference, in their entirety. Aspects of the embodiments can be modified, if necessary, to employ systems, circuits and concepts of the various patents, applications and publications to provide yet further embodiments.

The invention claimed is:

1. A dimmer plug that is coupleable to a three contact socket of a luminaire, the three contact socket having three female receptacles, the dimmer plug comprising:

a housing having a first face;

only three male electrical contacts, the three male electrical contacts which extend from the first face of the housing, and arranged with respect to one another in a first arrangement;

a receiver housed by the housing and operable to receive input signals; and circuitry housed by the housing and communicatively coupled to the receiver, the circuitry operable to provide an output signal via one of the three male electrical contacts based on the input signals received by the receiver and operable to control dimming of the luminaire without controlling a line power of the luminaire.

2. The dimmer plug of claim 1 wherein circuitry produces the output signal as a pulse-width modulated signal.

3. The dimmer plug of claim 1 wherein circuitry adjusts a duty cycle of the pulse-width modulated signal to adjust a level of illumination produced by the luminaire.

4. The dimmer plug of claim 1 wherein circuitry produces the output signal as a frequency modulated signal.

5. The dimmer plug of claim 1 wherein circuitry produces the output signal as a digitally coded signal.

6. The dimmer plug of claim 1 wherein circuitry produces the output signal as an analog signal with a range of 0 volts to 100 volts.

7. The dimmer plug of claim 1 wherein the receiver is a radio receiver and further comprising an antenna communicatively coupled to the radio receiver to wirelessly receive the input signals.

8. The dimmer plug of claim 1 wherein the receiver is a wire-line receiver electrically coupled to receive the input signals via an electrical power line coupled to the luminaire.

9. The dimmer plug of claim 1 wherein the three male electrical contacts comprises an AC line contact, an AC neutral contact, and an control signal contact.

10. The dimmer plug of claim 1 wherein the only three male electrical contacts are sized, dimensioned, shaped, and are arranged with respect to one another according to fit a socket that complies with a National Electrical Manufacturer Association (NEMA) C136 specification in existence as of Jan. 1, 2016.

11. The dimmer plug of claim 1 wherein the dimmer plug is a twist lock plug.

12. The dimmer plug of claim 1 wherein the housing has a thickness and a second face, the second face opposed across the thickness of the housing from the first face, and the housing includes a plurality of female electrical contacts accessible from the second face, the female electrical contacts electrically coupled to the circuitry.

13. The dimmer plug of claim 12 wherein the housing includes either five or seven electrical contacts accessible from the second face.

14. The dimmer plug of claim 13 wherein the five or seven electrical contacts are sized, dimensioned, shaped and arranged to receive at least one of a five position dimming controller and a seven position dimming controller.

15. The dimmer plug of claim 14 wherein the housing includes a plurality of pad electrical contacts accessible from the second face.

16. The dimmer plug of claim 15 wherein the circuitry receives the input signals from the dimming controller.

17. The dimmer plug of claim 1, further comprising:

a light sensor communicatively coupled to the circuitry to provide the circuitry with an electrical signal representative of light sensed by the light sensor.

18. The dimmer plug of claim 17 wherein the light sensor includes at least one of either a photo-sensor, a photodetector, and a photo-diode.

19. A dimmer plug that is coupleable to a three contact socket of a luminaire, the three contact socket having three female receptacles, the dimmer plug comprising:

a housing having a first face;

only three male electrical contacts, the three male electrical contacts which extend from the first face of the housing, and arranged with respect to one another in a first arrangement;

a receiver housed by the housing and operable to receive an input signal that is not obtained from a light sensor; and circuitry housed by the housing and communicatively coupled to the receiver, the circuitry operable to provide an output signal via one of the three male electrical contacts based on the input signals received by the receiver.

20. The dimmer plug of claim 19, wherein the circuitry is operable to control dimming of the luminaire without controlling a line power of the luminaire.

21. The dimmer plug of claim 19 wherein the input signal received by the receiver is not representative of a level of light in an external environment, and the circuitry is operable to control dimming of the luminaire based at least in part on the input signal that is not representative of a level of light in the external environment.

* * * * *